United States Patent [19]

Stephens

[11] 4,136,945

[45] Jan. 30, 1979

[54] ELECTROPHOTOGRAPHIC APPARATUS HAVING COMPENSATION FOR CHANGES IN SENSITOMETRIC PROPERTIES OF PHOTOCONDUCTORS

[75] Inventor: Curtis L. Stephens, Rochester, N.Y.

[73] Assignee: Eastman Kodak Company, Rochester, N.Y.

[21] Appl. No.: 846,666

[22] Filed: Oct. 28, 1977

Related U.S. Application Data

[63] Continuation of Ser. No. 621,940, Oct. 14, 1975, abandoned.

[51] Int. Cl.[2] ..... G03G 15/16

[52] U.S. Cl. ..... 355/14; 355/69

[58] Field of Search ..... 355/14, 69, 71

[56] References Cited

U.S. PATENT DOCUMENTS

| | | | |
|---|---|---|---|
| 2,956,487 | 10/1960 | Giaimo, Jr. | 355/14 |
| 3,438,704 | 4/1969 | Schoen | 355/8 |
| 3,575,505 | 4/1971 | Parmigiani | 355/14 X |
| 3,672,759 | 6/1972 | Bauer | 355/3 R |
| 3,738,242 | 6/1973 | Lee et al. | 355/69 X |
| 3,788,739 | 1/1974 | Coriale | 355/14 X |
| 3,892,481 | 7/1975 | Schaefer et al. | 355/14 X |
| 3,914,147 | 10/1975 | Hunt et al. | 355/14 X |
| 3,922,380 | 11/1975 | Rowell et al. | 355/14 X |

FOREIGN PATENT DOCUMENTS 1398576 6/1975 United Kingdom.

*Primary Examiner*—Michael L. Gellner
*Attorney, Agent, or Firm*—John D. Husser

[57] ABSTRACT

An illumination control system for electrographic apparatus of the type utilizing a reusable photoconductive insulator member that changes in electro-photosensitive properties during the period of its useful life. The system includes a device for sensing and storing usage information about such member, for providing signals representative of cumulative usage of the member and for increasing the exposure of the member in accordance with a non-linear schedule which corresponds to photochemical, sensitometric changes that occur in the member with increasing cumulative usage.

6 Claims, 4 Drawing Figures

ELECTROPHOTOGRAPHIC APPARATUS HAVING COMPENSATION FOR CHANGES IN SENSITOMETRIC PROPERTIES OF PHOTOCONDUCTORS

This is a continuation of application Ser. No. 621,940, filed Oct. 14, 1975, now abandoned.

BACKGROUND OF INVENTION

1. Field of Invention

The present invention relates to a device for regulating one or more of the operative stations of an electrophotographic apparatus to provide more uniform copy output. More specifically, the invention concerns such regulation in electrophotographic apparatus to compensate for sensitometric changes in its photoconductive insulator member occurring during the period of its overall lifespan.

2. Description of Prior Art

It has been observed that under repeated use in electrophotographic apparatus, certain properties of a photoconductive insulator member (herein referred to also merely as a photoconductor) deteriorate because of surface scumming. Specifically, U.S. Pat. No. 3,575,505 describes that the ability of such a photoconductor to discharge in background (light exposed) areas, decreases with repeated use as residual electrographic developer, not removed by cleaning operations, builds up on the photoconductor. To eliminate the adverse effect of this variation in charge dissipation per given exposure, that patent teaches the provision of a compensating variation in the bias of the development electrode located at the toner application station. In the patent it is indicated that the program for such compensation can be keyed to a cumulative copy count or to the cumulative amount of toner usage.

Also, it has been observed heretofore that the electrical properties of photoconductive insulating members become temporarily electrically fatigued after repeated reuse, "electrical fatigue" in this context referring to a change in photo-electrical responses of the member associated with the accumulation of trapped electrons within the volume of the member. Prior art techniques for avoiding the adverse effects of electrical fatigue include (1) exposing the member to an erase illumination, separate from the imaging illumination; (2) heating the member and (3) applying regenerative charge to the photoconductive insulating member of polarity opposite the primary charge. (See for example U.S. Pat. Nos. 2,741,959 and 2,863,767 and *Electrophotography* by R. M. Schaffert, 2nd Edition, page 87.)

While the prior art techniques for compensating for scumming and electrical fatigue are effective to some extent in achieving more predictable performance from reusable photoconductive insulator members, and hence more uniform copy output, I have discovered that certain photoconductors undergo changes in sensitometric properties during their useful lifespan (e.g., 60,000 cumulative copy-making usages) which are not related to physical effects such as scumming or electrical fatigue. It is hypothesized that these changes are related to changes in the chemical structure of the photoconductors, caused by photochemical decomposition and/or ion bombardment. I have further noted that these changes in sensitometric properties will occur, in a given specie of photoconductor subjected to a repeated reuse in a given apparatus cycle, according to a definite program, which can be determined empirically and which is applicable to all photoconductors of the same type. It has been found advantageous to compensate for such sensitometric changes, either separately or in conjunction with the prior art techniques which compensate for scumming and electrical fatigue, to achieve more uniform copy during the lifespan of the photoconductor.

SUMMARY OF INVENTION

It is therefore an object of the present invention to provide, in electrophotographic apparatus of the type having a reusable photoconductive insulator member, improved apparatus and technique for compensating for sensitometric changes occurring in the member during the period of its total cumulative usage.

A more specific object of the present invention is to provide means for controlling one or more of the operative stations of such apparatus to compensate, according to a predetermined program, for changes occurring in the chemical composition of its reusable photoconductor during useful life of that member.

A further object is to provide improved compensation for such variation in sensitometric properties by regulation of imagewise exposure according to a nonlinear program.

These objectives are accomplished by providing in the electrophotographic apparatus means for monitoring the total cumulative usage of the photoconductor in the apparatus and means for controlling one or more of the electrophotographic operations of the apparatus, in accordance with a predetermined program, designed empirically, to compensate for those changes in sensitometric properties of the photoconductor that occur during the life of the photoconductor due to changes in chemical composition thereof.

One preferred embodiment of the invention includes means for sensing total cumulative photoconductor usage in the apparatus, actuatable means for incrementally varying the magnitude of imagewise exposure and apparatus logic operating in accordance with a predetermined program to actuate an increase in exposure in response to signals indicating that various stages of total cumulative photoconductor usage have been reached.

BRIEF DESCRIPTION OF DRAWINGS

In the following detailed description of preferred embodiments of the invention, reference is made to the accompanying drawings in which like numerals denote like parts and wherein.

DETAILED DESCRIPTION OF PREFERRED EMBODIMENTS

Figure 1:
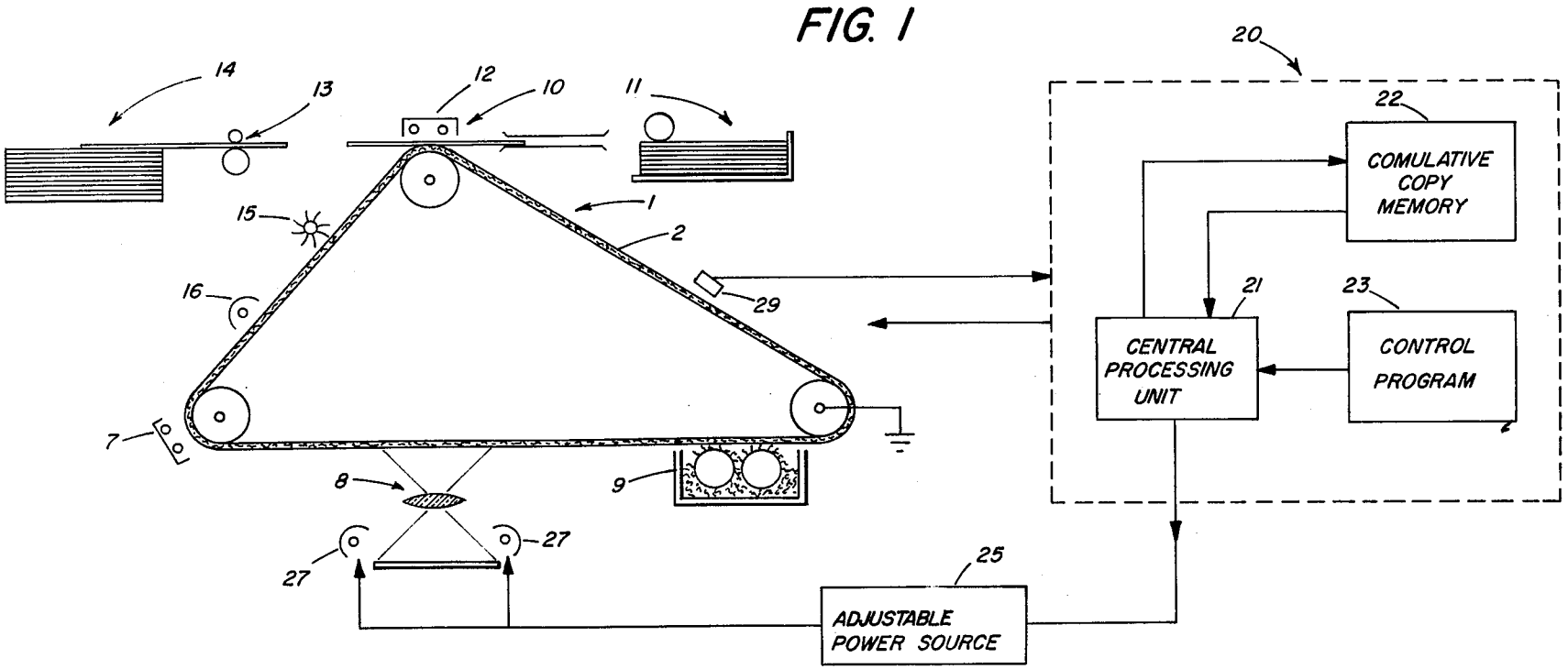
FIG. 1 is a schematic diagram illustrating one embodiment of electrophotographic apparatus embodying the present invention.
Figure 2:
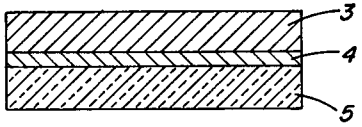
FIG. 2 is an enlarged cross section of the flexible photoconductor web shown in FIG. 1.

In FIG. 1, the electrophotographic apparatus 1 comprises a flexible imaging member 2 configured for movement around an endless path past various operative stations of the apparatus. As can be seen more clearly in FIG. 2, the imaging member 2 includes a photoconductive insulating layer 3 overlying a thin, transparent, electrically-conductive layer 4 both supported on a film 5. The conductive layer 4 is electrically connected to ground or other reference potential source by edge contact with rollers of the apparatus 1 or by other techniques known in the art (see for example U.S. Pat. No. 3,743,410).

Operative stations of the apparatus 1 include a primary charging station at which corona device 7 applies an overall electrostatic charge to external surface of photoconductive insulating layer 3. After receiving the primary charge, an image segment of the member 2 advances past the exposure station 8 where the segment is imagewise exposed to light patterns of a document to be copied by Xenon flash lamps or other known illuminating apparatus. The latent electrostatic image then residing on the segment is next advanced over a magnetic brush development station 9 where toner is attracted to the charge pattern corresponding to dark image areas of the document. The developed image is then advanced to a transfer station 10 where the toner image is transferred by corona device 12 to paper, fed from supply 11.

The paper bearing the toner image is then transported through a fixing station 13 (for example, a heated roller fusing device) to a bin 14. The segment from which the toner is transferred meanwhile advances past a cleaning station 15 in preparation for another copy cycle. Erase illumination source 16 can be located after the cleaning station to dissipate residual charge prior to initiating another copy making sequence of each belt segment.

As indicated schematically in FIG. 1, the operation of the various operative stations of the apparatus 1 are controlled, in proper timed relation to movement of the image segments on photoconductor 2, by a logic and control unit 20 which receives input signals from a sensor 29 and provides various control signals to the electro-mechanical devices comprising the various operative stations of the apparatus. The details of such a control unit and its cooperation with apparatus such as apparatus 1 are disclosed in more detail in copending U.S. application Ser. No. 550,104 entitled SYNCHRONIZING CONTROL APPARATUS FOR ELECTROPHOTOGRAPHIC APPARATUS USING DIGITAL COMPUTER, filed Feb. 13, 1975 in the name of Hunt et al., now U.S. Pat. No. 4,025,186, the disclosure of which is hereby incorporated by reference herein. However, within the logic and control unit 20 illustrated in FIG. 1 are indicated several portions of the unit which cooperate more directly with the structure and operation of the present invention. Specifically, the unit 20 includes a central processing unit 21 such as is utilized in commercially available programmable minicomputers and microprocessors, a total cumulative copy memory 22 and a control program 23. As is also schematically illustrated in FIG. 1, one output from the logic and control unit 20 leads to an adjustable power source 25 for the illumination source(s) 27 of the exposure station 8.

Generally, in operation the usage of a photoconductor is sensed by the central processing unit 21 each time a copy cycle is effected under control of the processing unit and total cumulative usage of that photoconductor is stored in memory 22. Operating under the direction of stored control program 23, the central processing periodically commands a signal indicative of total cumulative usage of a given photoconductor from the memory 22 and when the total cumulative usage signals match predetermined usage stages indicated in control program 23 as requiring compensation, processing unit 21 directs a signal to adjustable power source 25 to effect a change in the level of illumination utilized in exposure of the photoconductor to original documents.

More specifically, in accordance with one embodiment of the invention, eight bits of nonvolatile memory of the logic and control unit 20 are allocated as memory 22, to store the running cumulative count of all copy cycles on a given photoconductor from the time of its insertion into the apparatus. The least significant bit corresponds to a copy count of 256 and a total copy count in excess of 65,000 can be represented in increments of 256. During machine operation, the cumulative (nonvolatile) copy count memory 22 is powered from a DC power supply of the main apparatus; however, a battery power supply also is provided for this memory portion to prevent destruction of the stored cumulative copy count when the main power to the apparatus is off. Incremental copy counts up to 256 are effected in a temporary memory portion of the central processing unit, which is cleared at each delivery of a "256 cumulative copies" signal to memory 22 and each time main machine power is shut off. Provision is made in control program 23 for resetting memory 22 to a zero cumulative copy count when a new photoconductor is installed in the apparatus.

Figure 3:
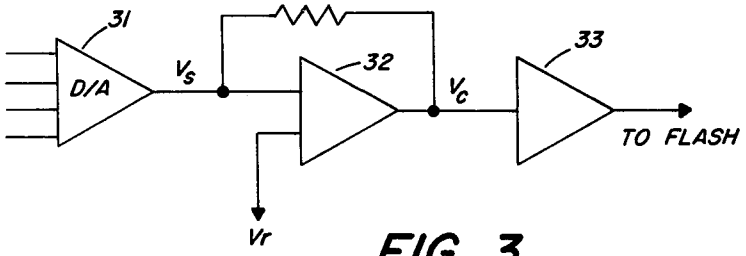
FIG. 3 is a schematic diagram of an exemplary circuit by which compensation signals can control exposure.

In response to a compensation-requiring comparison between the cumulative copy memory 22 and the stored control program 23, central processing unit 21 outputs an appropriate four bit digital signal, under the direction of program control 23, to adjustable power source 25. As can be seen in more detail in FIG. 3, the adjustable power source 25 can comprise a conventional digital to analog converter 31 which produces an output signal voltage Vs of magnitude determined by the particular digital signal presented at its four input terminals. A variable gain or summing operational amplifier 32 provides a control voltage output signal Vc proportional to the sum of signal voltage Vs and reference voltage Vr presented to its input terminals and a power amplifier 33 provides power proportional to the control voltage Vc presented thereto to the illumination source, e.g., to the charging capacitor of a conventional xenon flash lamp pack.

As previously discussed, the particular program for adjusting illumination over the life of a particular type of photoconductor can be determined empirically, and the performance of photoconductors, e.g., of the type disclosed in U.S. Pat. No. 3,615,414, can be enhanced significantly by modification of exposure according to a predicted schedule in accordance with the present invention. For example, one preferred embodiment of the invention has been utilized with a photoconductor comprising a multiphase aggregate photoconductor composition including a continuous phase containing a solid solution of an organic photoconductor, i.e., 4,4' bis-(diethylamino)-2,2'-dimethyltriphenylmethane, and an electrically insulating polymer binder, i.e., Lexan 145 polycarbonate sold by General Electric Corporation, having dispersed therein a discontinuous phase comprising a finely divided particulate co-crystalline complex of (i) at least one polymer having an alkylidene diarylene group in a recurring unit, i.e,, Lexan 145 polycarbonate, and (ii) at least one pyrylium-type dye salt, i.e., 4-(4-dimethylaminophenyl)-2,6-diphenyl thiapyrylium fluoroborate, The apparatus generally as described with respect to FIGS. 1–3 was programmed to provide an increase in power to the flash lamps sufficient to achieve a 0.03 Log E increase in exposure illumination at the 15,000 copy; 35,000 copy and 60,000 copy stages of the lifespan of that photoconductor. The initial exposure level was selected to achieve optimum copy output, e.g., in terms of the background density for copies of different colored originals and rendition of details in shadow areas of half-tone originals. The uniformity of copies produced (i.e., the maintaining of copy output substantially constant in terms, e.g., of background density and rendition of detail) over a 60,000 copy lifespan using the aforementioned compensation technique has been found significantly better than the uniformity achievable over such a lifespan without such compensation. Equivalent exposure increases at the 500 copy; 2,000 copy; 7,000 copy; 15,000 copy and 60,000 copy stages have also been utilized with photoconductors of the type disclosed in U.S. Pat. No. 3,615,414 to provide increased uniformity.

Adjustment of imagewise exposure (in contrast for example to varying the primary change or the magnetic brush bias) has been found particularly advantageous in accordance with the present invention. The cause of the particularly preferred effects of exposure compensation can be understood by considering an illustrative situation wherein a fresh photoconductor having an initial overall charge of 450 volts is discharged per given exposure by background (white) areas of a document to 200 volts, with a bias on the development station of 50 volts above background voltage. With increasing cumulative copy cycles a change in the sensitometry of the photoconductor might cause the background area to discharge only to 250 volts for the same exposure condition. Compensation could be made by varying the primary charge, for illustration purposes, say, to approximately 400 volts, thereby causing a resulting background charge of 200 volts, consistent with that of the fresh photoconductor, the bias of the magnetic brush remaining at 250 volts. Instead of varying the primary charge, the bias of the magnetic brush could be raised, for example to 300 volts, to compensate for such sensitometric change in the photoconductor. However, it will be noted that varying the primary charge and bias both reduce the contrast of the electrophotographic system. That is the "background-maximum charge area" difference in the varied primary charge situation is 150 volts (400 minus 250) and with varied bias is likewise 150 volts (450–300). In distinction, varying exposure provides a contrast remaining at 200 volts (450–250). As is well known increased contrast is desirable, for example, for providing the ability to retain more detail in reproductions, especially those reproductions representing weak (low density) information.

Although, as described above, compensation by variation of exposure has unique advantages, adjustment of other of the operative stations of electrophotographic apparatus can be implemented in accordance with a predetermined non-linear program during the lifespan of a photoconductor, in combination with adjustment of exposure or separately, to compensate for the change in sensitometric properties occurring during the lifespan. The apparatus in FIG. 4 illustrates schematically modes of implementing various such compensations, as well as an alternative structure for varying exposure.

Figure 4:
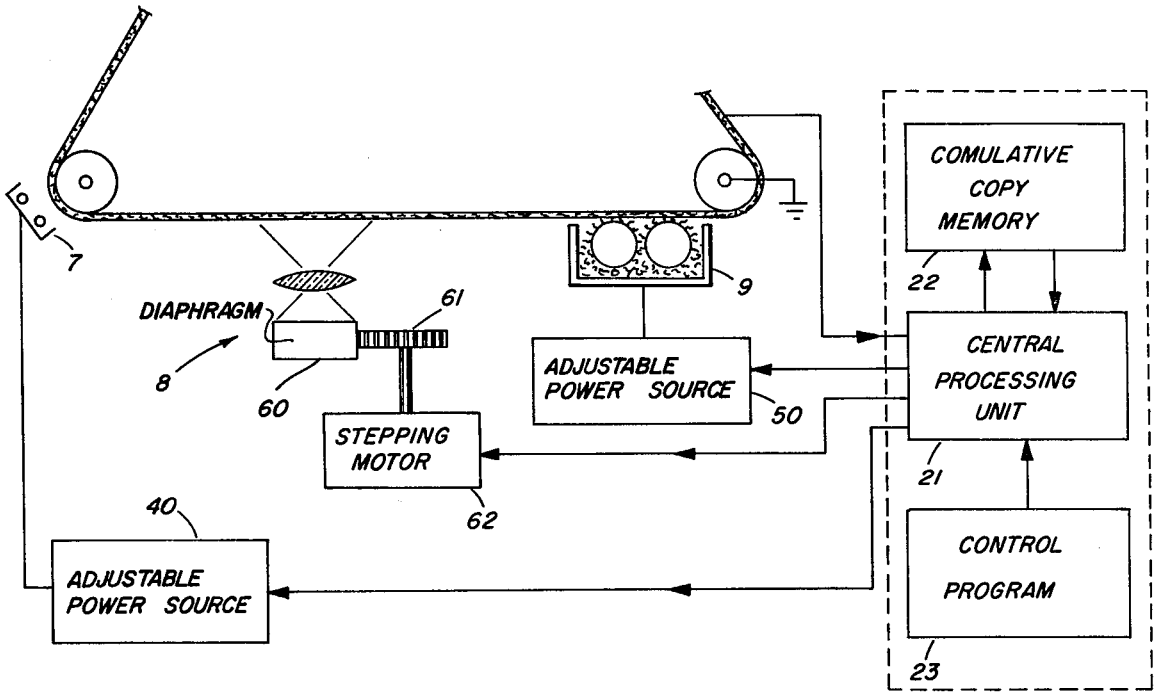
FIG. 4 is a schematic diagram illustrating alternative embodiments of compensation in accordance with the present invention.

The apparatus illustrated in FIG. 4 is like that described with respect to FIG. 1; however, as shown, signals from the central processing unit 21 of logic and control unit 20 are directed to the development station 9 and the primary charging station 7, as well as to the exposure station 8. In operation, the copy count is input to and sensed by the central processing unit 21 in response to an operation of the electrophotographic apparatus, e.g., copy sheet feed, or flash actuation, and stored in a storage location of memory 22; and in accordance with a predetermined control program 23, the processing unit 21 signals adjustments at various cumulative copy counts which correspond to stages of the life of a photoconductor. As shown, such adjustment signals include a signal to an adjustable power source 40 for primary charging unit 7. It will be understood that the source 40 can be similar to source 25 described with respect to FIGS. 1 and 3; however, the amplifier 32 would in this instance be a differential input amplifier which effected a decrease in the level of primary charge incrementally over the cumulative photoconductor life. Similarly, an adjustable power source 50, like that described with respect to FIGS. 1 and 3, can be utilized to incrementally increase the bias of magnetic brushes at development station 9 according to a predetermined non-linear program, to compensate for the increasing level of background charge which occurs during the photoconductor lifespan due to speed loss of the element over that period.

It will be understood also that various combinations of compensation at the exposure, primary charging and/or development stations can be determined empirically and implemented by the central processing unit 21, under control of an appropriate program, by one knowledgeable of computer programming techniques given the teachings herein.

FIG. 4 also illustrates an alternative structure for adjusting exposure which comprises an adjustable diaphragm 60 driven via drive gear 61 by a conventional stepping motor 62. The processing unit 21 in such instance can be designed to provide only a control pulse to actuate motor 62 to advance one increment at each adjustment stage, such advance enlarging the diaphragm opening an appropriate area to compensate for an increment of variation in the sensitometry of the photoconductor. It will be appreciated that exposure also can be varied by other structures in accordance with the present invention, e.g., by incrementally changing the threshold level of the photocell controlled trigger circuit of an electronic shutter device to increase the exposure time as film speed decreases over its lifespan.

The invention has been described in detail with particular reference to preferred embodiments thereof, but it will be understood that variations and modifications can be effected within the spirit and scope of the invention.

I claim:

1. In electrophotographic apparatus of the type utilizing a reusable photoconductor and including means for uniformly electrostatically charging the photoconductor and means for exposing the photoconductor to an imagewise pattern of radiation, said charging and exposing means being cyclically operable to form a latent electrostatic image, the improvement comprising:

(a) actuatable means, operatively associated with said exposing means, for adjusting the magnitude of imagewise exposure of the photoconductor;

(b) sensing means for providing a signal indicative of a cycle of apparatus operation;

(c) storage means for receiving such signals from said sensing means and for storing information representative of the cumulative usage of the photoconductor, said storage means being actuatable at various stages during the useful life of such photoconductor to provide a signal indicative of the current status of cumulative usage of such photoconductor; and (d) control means for actuating said storage means, and responsive to the cumulative usage signal therefrom, for actuating said exposure adjusting means in accordance with a control program based on the differing sensitometric characteristics of the photoconductor at each of a plurality of stages during its useful lifespan.

2. The invention defined in claim 1 wherein said control means effects a change of exposure in a non-linear relation with respect to cumulative usage of the photoconductor.

3. The invention defined in claim 1 wherein said control means actuates said exposure varying means in accordance with empirically determined changes in the chemical composition of the specific type of photoconductor utilized in said apparatus.

4. In electrophotographic apparatus of the type having a reusable photoconductor and including charging, exposing and developing stations, which cooperatively function during a cycle of operation to produce a developed image on the photoconductor, the improvement comprising:

(a) sensing means for signalling a cycle of apparatus operation;

(b) storage means, responsive to signals from said sensing means, for storing information representative of cumulative usage of the photoconductor, said storage means periodically providing a signal indicative of current cumulative photoconductor usage; and (c) control means, responsive to a signal from said storage means, for adjusting at least one of said apparatus stations according to a nonlinear schedule based on photochemical, sensitometric changes occurring in the photoconductor over its useful lifespan.

5. In electrophotographic apparatus of the type utilizing a reusable photoconductor which exhibits photochemical sensitometric changes that occur predictably in accordance with cumulative usage, such apparatus including means for uniformly electrostatically charging the photoconductor and means for exposing the photoconductor to a radiation pattern to form, in respective cycles of operation, latent electrostatic images, the improvement comprising:

(a) means for providing signals representative of individual apparatus operation cycles;

(b) logic and control means responsive to said operation cycle signals for storing a signal representative of current cumulative-photoconductor-usage, for comparing said stored signals to a predetermined schedule, and in response to such comparison, for providing separate output digital signals representative of desired exposures which compensate for predicted photochemical sensitometric photoconductor changes;

(c) means responsive to said digital signals to provide compensation signals representative thereof; and (d) an adjustable power supply operatively associated with said exposure means and responsive to said compensation signals for adjusting said exposure means to vary the image exposure of the photoconductor.

6. In electrophotographic apparatus of the type utilizing a reusable photoconductor which has predictable photochemical sensitometric changes that occur in accordance with cumulative usage, such apparatus including means for uniformly electrostatically charging the photoconductor, and adjustable means for exposing the photoconductor to a radiation pattern to form latent electrostatic images in respective cycles of operation, the improvement comprising:

(a) means for providing signals indicative of an operative cycle;

(b) logic and control means, responsive to such cycle signal, for storing a signal representative of current cumulative-photoconductor-usage, for comparing said stored signal to a predetermined schedule, and, in response to such comparison, for providing separate output signals representative of desired exposures which compensate for predicted photochemical sensitometric photoconductor changes; and (c) an adjustable power supply coupled to said exposure means and responsive to said output signals for varying the magnitude of the image exposure of the photoconductor.

* * * * *